United States Patent [19]

Suzuki et al.

[11] 3,965,716

[45] June 29, 1976

[54] DEVICE FOR SWAGE-FORGING SHAFTS

[75] Inventors: Yoshikazu Suzuki, Chiryu; Katsumi Azuma, Okazaki; Kiyoshi Ishimura, Toyota, all of Japan

[73] Assignee: Toyota Jidosha Kogyo Kabushiki Kaisha, Japan

[22] Filed: Jan. 22, 1975

[21] Appl. No.: 543,183

[30] Foreign Application Priority Data

Oct. 15, 1974 Japan ..... 49-118510

[52] U.S. Cl. ..... 72/356; 72/357; 10/11 A

[51] Int. Cl.[2] ..... B21J 13/02

[58] Field of Search ..... 29/40; 10/11 A, 13, 10/24, 11 E, 76 R, 11 R, 12 R, 19; 72/344, 357, 356, 361, 427

[56] References Cited

UNITED STATES PATENTS

| | | | |
|---|---|---|---|
| 1,932,396 | 10/1933 | Clouse | 10/11 |
| 1,952,491 | 3/1934 | Bush et al. | 72/356 |
| 2,027,406 | 1/1936 | Spatta | 72/306 |
| 2,104,297 | 1/1938 | Friedman | 10/11 |
| 2,278,293 | 3/1942 | Watson | 10/24 |
| 2,768,394 | 10/1956 | Ward | 10/13 |
| 2,799,027 | 7/1957 | Hatebur | 10/12 R X |
| 3,245,097 | 4/1966 | Domingo | 10/13 |
| 3,299,453 | 1/1967 | Van de Meerendonk | 10/12 R |
| 3,551,926 | 1/1971 | Ferre | 10/13 |
| 3,688,717 | 9/1972 | Rudolph et al. | 72/356 X |
| 3,755,839 | 9/1973 | Enody et al. | 10/13 |

FOREIGN PATENTS OR APPLICATIONS

| | | | |
|---|---|---|---|
| 749,690 | 5/1943 | Germany | 10/13 |

*Primary Examiner*—Lowell A. Larson
*Attorney, Agent, or Firm*—Oblon, Fisher, Spivak, McClelland & Maier

[57] ABSTRACT

Device for swage-forging shafts has a lower die set which permits sidewise insertion of the work installed on the bed of a press assembly, and a rotary die set circumferentially equipped with a plurality of upper dies having definite shapes corresponding to each swaging step installed on the ram of said press assembly, said upper dies being arranged to be successively brought into position above the work on said lower die set by rotation of said rotary die set, whereby reciprocation of the ram will swage-forge the work.

9 Claims, 8 Drawing Figures

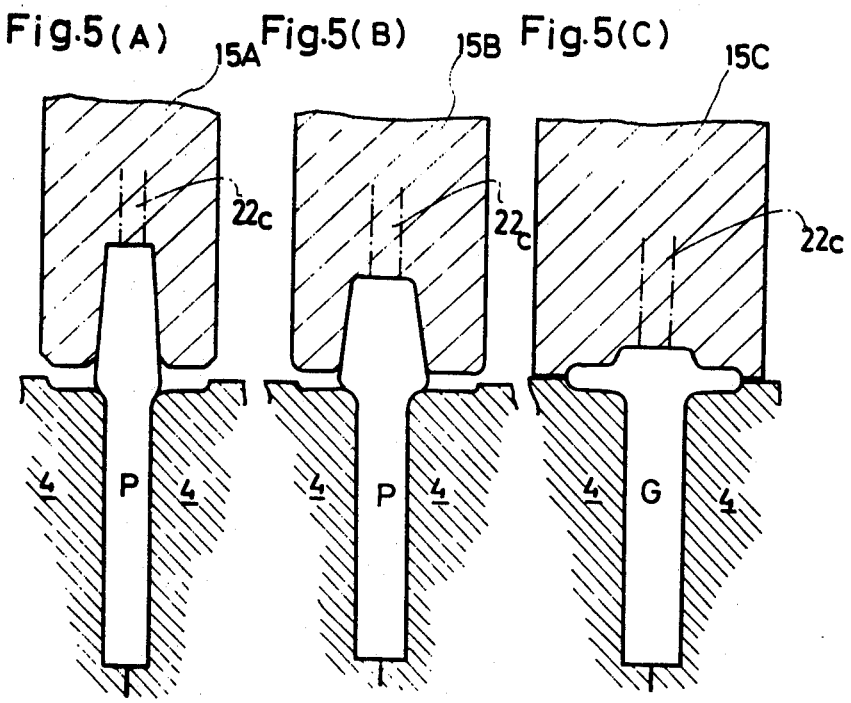
Fig. 6
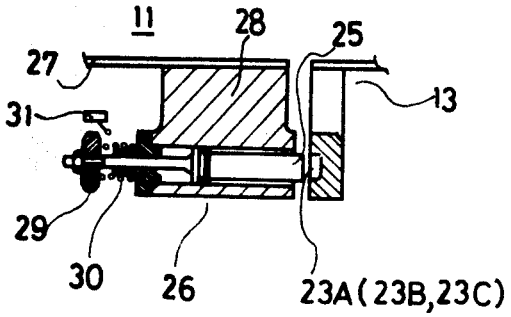

DEVICE FOR SWAGE-FORGING SHAFTS

BACKGROUND OF THE INVENTION

1. Field of the Invention:

The present invention relates to a device for swaging a shaft and hammering the head of it, more specifically to a forging device which permits a long shaft to be swaged and continuously forged in a vertical press.

2. Brief Description of the Prior Art:

Swage-forging of a long shaft by a vertical press, which involves a plurality of steps, has not heretofore been satisfactorily undertaken because of the difficulties caused by the shortness of the press stroke, the extreme inconvenience of introducing and removing the work, the delayed action of the press when the stroke is prolonged, and the need for reheating. For these reasons, in the conventional method of working a long shaft which involves a plurality of steps, the step of shaping by an upsetter or the step of swaging during resistance heating is followed by a pressing step for the final shaping.

The kinds of parts which need to be shaped by an upsetter, however, are few and it is expensive to prepare and maintain such an upsetter exclusively for this small number of parts. Moreover, swaging during resistance heating is a troublesome step so that a relatively long time is required to finish the forging work.

SUMMARY OF THE INVENTION

The primary object of the present invention is to provide a device for swage-forging a shaft which is applicable to swaging the part in a press.

Another object of the present invention is to provide a swage-forging device which permits the stamping of a shaft in several steps without requiring reheating.

Still another object of the present invention is to provide a swage-forging device which facilitates the introduction of the work into and its removal from a vertical press.

Still another object of the present invention is to provide a swage-forging device in the form of a vertical press the ram of which is equipped with a rotary die set comprising a plurality of upper dies, whereby the work can be swaged to a desired shape by the rotational movement of said rotary die set during the down stroke of the ram.

Other features and benefits of the present invention will be evident from the following description of a preferred embodiment thereof, with reference to the attached drawings, in which.

FIGS. 5A, 5B and 5C schematically illustrate the working steps carried out by a device according to the present invention; and FIG. 6 is a longitudinal sectional view taken through the lock mechanism.

Figure 1:
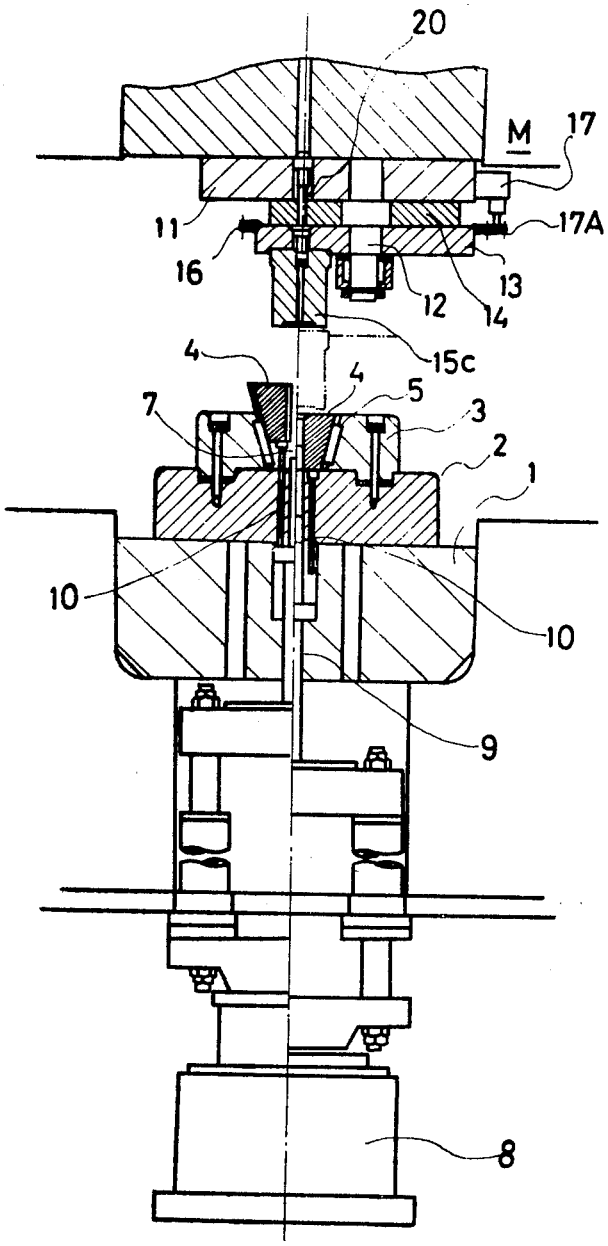
FIG. 1 is a sectional view of a vertical press equipped with a device according to the present invention, the half to the right of the central line showing the state in which the lower die is closed and the half to the left showing the state in which the lower die is open.
Figure 2:
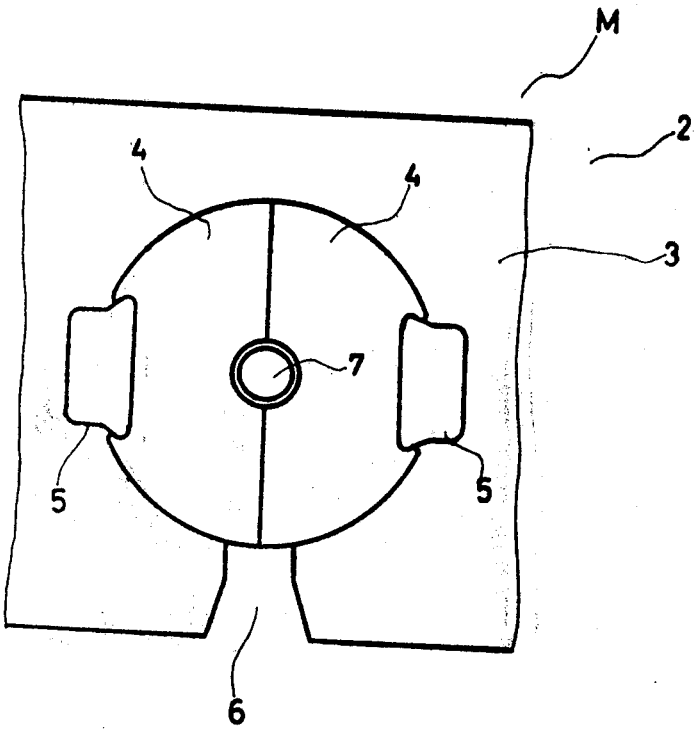
FIG. 2 is an enlarged plan view of the lower die set.

The preferred embodiment of the present invention will now be described with reference to the drawings. In the press assembly M, a lower die set 2 is located on a bed 1. As illustrated in FIG. 2, the lower die set 2 consists of a die holder 3 and a pair of dies 4,4 assembled in said die holder. As seen from FIG. 1, the contacting surfaces of said dies 4,4 and said die holder 3 are sloped so that the dies 4,4 can fit in and fill said die holder 3 with a wedging action. Moreover, the lower die set 2, including said die holder 3, is provided with an opening 6 for receiving the work to be swaged.

Figure 3:
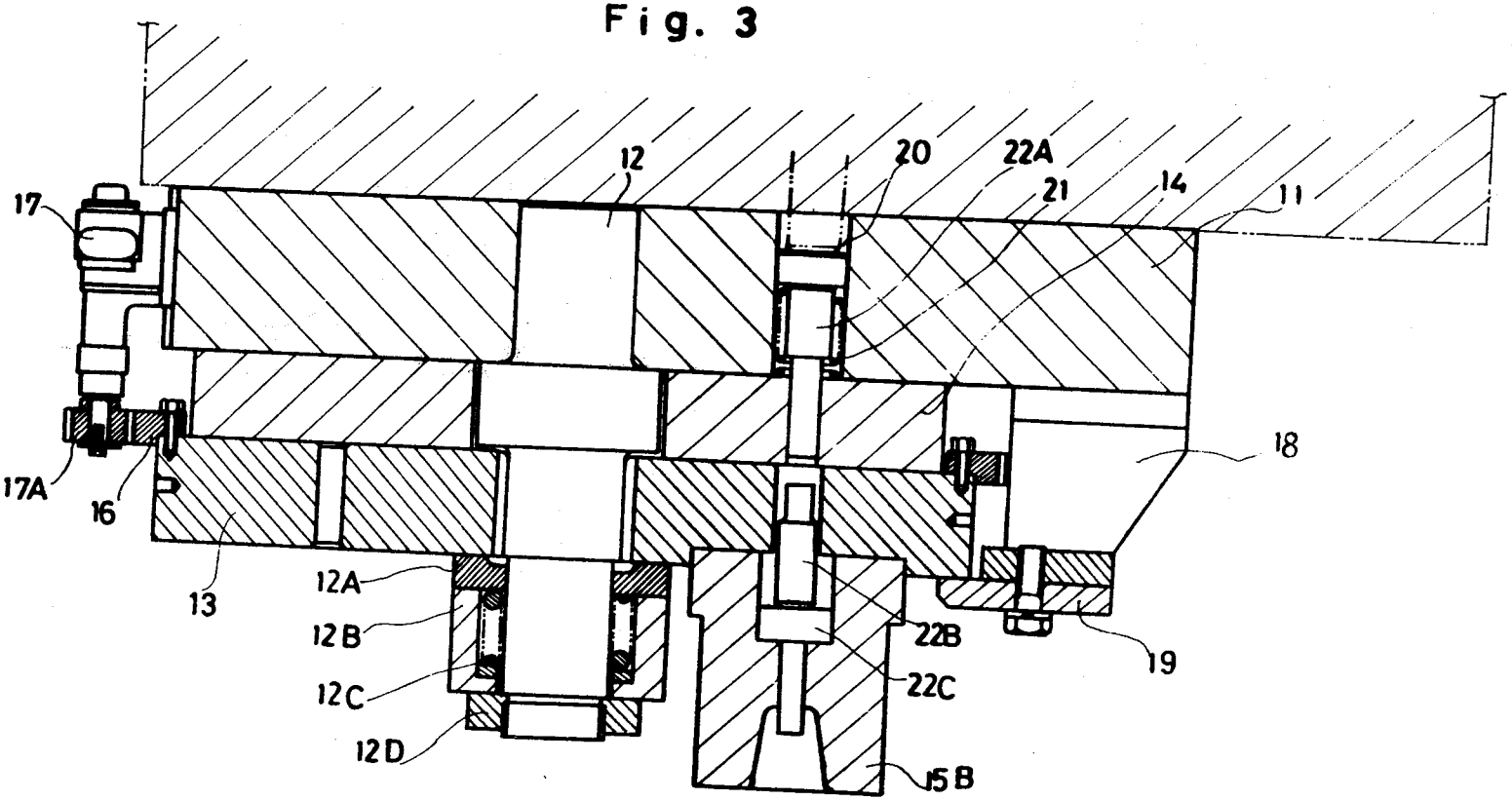
FIG. 3 is an enlarged longitudinal sectional view showing details of the rotary die set.

The die holder 3 and dies 4,4 are coupled together by positioning keys 5 so that the displacement of the die 4 is vertically restricted. Meanwhile, knockout pins 9, 10, actuated by a fluid pressure cylinder 8 installed below the bed 1 in alignment with the work-holding hole 7 provided between the dies 4,4 and beneath the dies 4,4, are mounted for vertical movement within the bed 1. FIG. 3 shows the details of the rotary die set.

Figure 4:
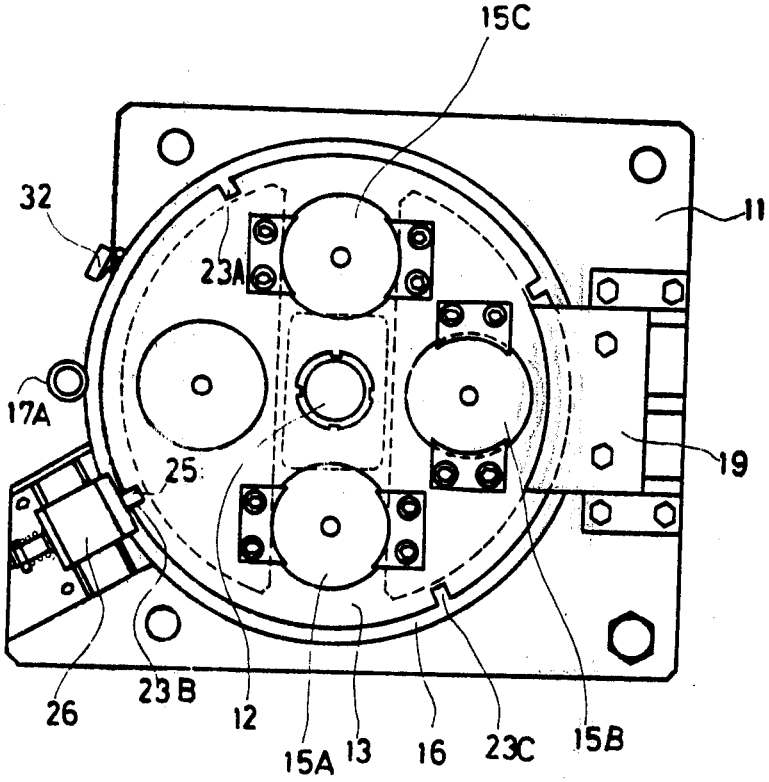
FIG. 4 is a bottom plan view of the rotary die set.

On the underside of the upper platen 11 carried by the ram of the press assembly M is an upper bolster 13 which is mounted on a supporting shaft 12 depending through a pressure-receiving plate 14 from the ram 11 of the press assembly M. The supporting shaft 12 extends through the center of the upper bolster 13 and is circumferentially equipped with a controller 12A and a sleeve 12B. Between the sleeve 12B and the controller 12A is a coil spring 12C. A nut 12D is screwed to the bottom end of said support shaft 12 and by adjusting the tightness of this nut, the pressure of the coil spring 12C is caused to act as a braking force on said upper bolster 13. The nut should be tightened firmly enough to eliminate any play between the upper bolster 13 and pressure receiving plate 14. On the contrary, it should not be so tight as to hinder the rotation of the upper bolster 13. On the underside of said upper bolster 13 is a rotary die set provided with the upper dies 15A, 15B, 15C having working surfaces of specified shapes as necessary for the successive working steps at each circumferential position around said support shaft 12, as illustrated in FIG. 4. At the same time, the upper bolster 13 is circumferentially equipped with a gear 16. A pinion 17A is driven by a motor 17 which is mounted on said upper platen 11 and the pinion 17A meshes with the gear 16. A bracket 18 projects from the upper platen 11 and a metal clamp 19 attached to the bracket 18 supports the bottom of the upper bolster 13. A part close to the part supported by said metal clamp 19 constitutes a stamping station, which is in vertical alignment with the lower die and the ram. Just above said dies 4,4 a hole 20 extends through the upper platen 11 and the pressure-receiving plate 14. The hole 20 houses the first upper knockout pin 22A which is urged upward by a spring 21. Second and third upper knockout pins 22B, 22C, corresponding to said upper knockout pin 22A are provided within the pressure-receiving plate 14 and within the upper dies 15A, 15B, 15C. Consequently the third upper knockout pin 22C faces the cavities in these upper dies. Normally (under no load) the first upper knockout pin 22A is held up by the spring 21, while the second and third knockout pins 22B, 22C are down under their own weight, but during working these pins are raised. After working, all the upper knock-out pins 22A–22C located on the same axis are pushed down, thereby pushing out the work held in the cavity of the upper dies 15A, 15B or 15C.

Referring now to FIG. 4, notches 23A, 23B, 23C for controlling the stopping position at the stamping station for each upper die are provided around the upper bolster 13, corresponding to the upper dies 15A, 15B, 15C. On one side of the upper base 11 is a lock mechanism 26 equipped with lock pins 25 which fit into the notches 23A, 23B, 23C. As indicated in FIG. 6, said lock mechanism 26 is mounted on the upper base 11 by means of a bracket 27. The lock pin 25 is mounted to slide freely in and out of its main body 28. A spring 30 is located between the cam 29 on the tip of the lock pin 25 and the main body 28. Entry of the lock pin 25 into any of the notches 23A, 23B, 23C is detected by a limit switch 31, which then transmits a signal to lower the ram of the press assembly. As shown in FIG. 5, the upper dies 15A, 15B, 15C have appropriate working surfaces to form the final product in accordance with the necessary sequence of steps.

In the illustrated embodiment, the work P is inserted into the central hole 7 between the dies 4,4 through the opening 6 in the lower die set 2 of the die holder 3, while the joint between said dies 4,4 is held open by pushing up these dies by means of the knockout pin 10 driven by the cylinder 8. Next the dies 4,4 are pushed into the die holder 3 and the work P is secured firmly between the dies 4,4 with a certain length of the work jutting out of the dies. Then the motor 17 is driven to rotate the pinion 17A, whose torque is transmitted to the gear 16, thereby causing rotation of the upper bolster 13. Thus, at first the upper die 15A is brought into position just above the work P, that is to say, into the stamping station. The angle of rotation is detected by a limit switch 32, which halts the work at a specified position. The pin 25 of the lock mechanism 26 is introduced into the notch 23A and locked in position. The limit switch 31 which detects the entry of the pin 25 into the notch 23 transmits a signal to the drive (not shown). Then the ram 11 drops, the upper die 15A strikes the work and the first step of forging is carried out as illustrated in FIGS. 5A–C. The work P enters the cavity in the upper die 15A and the knockout pins 22A–22C, when they are forced down by the rising ram, drive out the work which is held in the cavity. The operation is the same with the other dies 15B, 15C. Next, at the upper end of the ram, a rotational feed by said hydraulic motor 17 causes rotation of the upper bolster 13 at a specified angle. In the same way as above, the position of the upper bolster 13 is detected; the upper bolster 13 is locked by the lock mechanism 26; and then the second working step is carried out, using the die 15B.

As a result the work P is finished to the shape illustrated in FIG. 5B. In the same fashion the upper bolster 13 is rotated at a specified angle and the die 15C strikes the work P, thereby yielding a forged product G finished to the final shape as shown in FIG. 5C. When the three steps of forging are over, the hydraulic cylinder 8 is operated to push the knockout pins 9, 10 upward. With the forged product G and the dies 4,4 thus pushed up, the product can be taken out through the gap between the dies 4,4 thereby completing the forging process.

As explained above, according to the present invention the work held between the dies 4,4 can be formed into a final product by being stamped at consecutive stations by a rotatable upper bolster equipped with a plurality of dies. Thus, the work in the form of a bar supported beneath the dies can be efficiently stamped to a desired shape. Therefore, a continuous forging of the work to a desired shape can be done by merely presetting the operating sequence of the dies and properly arranging the dies or the die holder.

By adjusting the tightness of the screw 12D in the controller, the force of the spring 12C can be controlled. By adjusting the pressure acting on the controller 12A, the die bolster 13 is pressed against the pressure-receiving plate 14. Thus the die bolsters are rotatable and appropriate braking by the controller 12A will assure an effective application of the rotational position control. Moreover in stamping, since the die bolster 13 is held by the pressure-receiving plate 14 and the metal clamp 19 provided near the stamping station supports the bottom of said bolster, no strain occurs at the upper die bolster 13 and its supporting structure, thus assuring smooth rotation and stamping at each station.

The above example shows a case in which three upper dies are provided, but it goes without saying that the present invention freely applies to any case in which more than two dies are applied.

As described above, in the present invention a part of the lower die holder consists of a lower die set provided with an opening for introducing the work extending to the joint between the lower dies, and an upper rotary die set equipped with a plurality of upper dies available for working in several steps. Thus forging to a desired shape can be carried out in several steps by rotating the rotary die set and vertically moving the ram, without shifting the work each time it is struck, thereby increasing the working efficiency over that of any conventional method. According to the present invention, which permits the work to be introduced through the side of the die set, unlike the conventional swage-forging device of a vertical press, a shaft as long as 1000 mm can be swiftly forged.

What is claimed is:

1. Device for swage-forging a workpiece comprising a press having a vertically acting ram, said device comprising:

a. a lower die set consisting of a die holder and a lower die on the bed of said press, said die holder having internal wall means at its center defining a first opening in which said lower die is fitted and means defining a second opening at one side thereof which extends to one side of said first opening and said lower die so as to permit horizontal insertion of the workpiece into said die, said lower die being divided into at least two parts which can slide up and down along said internal wall means and having a work-holding hole provided therebetween;

b. a rotary die carrier attached to the ram of the press for rotation about a vertical axis and disposed above said lower die set;

c. a plurality of upper dies attached to said rotary die carrier, and disposed upon said carrier so as to be alignable with said lower die, each upper die having a working surface shaped to carry out one step in finishing the workpiece;

d. means for rotating said rotary die carrier; and e. means for stopping said carrier at each of a plurality of positions, in each of which one of said upper dies is in vertical alignment with said lower die.

2. Device as claimed in claim 1, wherein said die holder has inclined internal walls.

3. Device as claimed in claim 1, wherein said rotary die carrier comprises an upper bolster beneath said ram supported by a support shaft depending from said ram and extending through a pressure-receiving plate attached to the bottom of an upper platen attached to said ram, and said plurality of upper dies are arranged in a circle on the bottom of the upper bolster in their working order.

4. Device as claimed in claim 3, in which said upper bolster is equipped with a braking device which generates a constant braking force by pressing against said pressure-receiving plate.

5. Device as claimed in claim 3, wherein upper knockout pins for cooperatively ejecting the work from each upper die are provided within said platen and pressure-receiving plate at a stamping station aligned with said lower die.

6. Device as claimed in claim 4, wherein said braking device comprises a part of the upper bolster, a control member frictionally engaging said bolster part and carried by a support shaft which supports said controller through a sleeve-supported spring, and a nut screwed onto the end of said support shaft for adjustably tightening said sleeve.

7. Device as claimed in claim 1, comprising means for stopping said upper bolster at a specified angular position, said means including notches for stopping said upper dies in alignment with said lower die, said notches being located on a part of the circumference of said upper bolster at positions corresponding to each upper die, and a lock pin carried by the upper platen for insertion into said notches.

8. Device as claimed in claim 4, wherein:

said braking device is such that said support shaft extends through the center of said upper bolster and is circumferentially equipped with a controller and a sleeve, between which controller and sleeve a coil spring is interposed, and further comprising a nut screwed to said support shaft, the axial adjustment of said nut upon said shaft causing the pressure of said coil spring to be altered so as to act as a braking force upon said upper bolster.

9. Device as claimed in claim 1, wherein:

said carrier is eccentric with respect to the center of said press.

* * * * *